US008581682B2

(12) United States Patent
Patino et al.

(10) Patent No.: US 8,581,682 B2
(45) Date of Patent: Nov. 12, 2013

(54) MAGNET AIDED SOLENOID FOR AN ELECTRICAL SWITCH

(75) Inventors: Sam Patino, Mansfield, OH (US); Naveen Samuel Jesuraj, Grenoble (FR); Palanisamy Vellaiyanaicken, Chennai (IN); Ryan Schwan, Monroeville, OH (US)

(73) Assignees: Tyco Electronics Corporation, Berwyn, PA (US); TE Connectivity India Private Limited, Bangalore (IN)

( * ) Notice: Subject to any disclaimer, the term of this patent is extended or adjusted under 35 U.S.C. 154(b) by 18 days.

(21) Appl. No.: 12/575,245

(22) Filed: Oct. 7, 2009

(65) Prior Publication Data

US 2011/0080240 A1 Apr. 7, 2011

(51) Int. Cl.
*H01F 7/00* (2006.01)

(52) U.S. Cl.
USPC ..... 335/229; 335/220

(58) Field of Classification Search
USPC ..... 335/220–229
See application file for complete search history.

(56) References Cited

U.S. PATENT DOCUMENTS 3,805,204 A * 4/1974 Petersen ..... 335/255
4,419,643 A * 12/1983 Ojima et al. ..... 335/234
4,604,600 A * 8/1986 Clark ..... 335/261
4,859,975 A * 8/1989 Uetsuhara ..... 335/230
5,066,980 A * 11/1991 Schweizer ..... 335/255
5,268,662 A * 12/1993 Uetsuhara et al. ..... 335/229
6,005,459 A * 12/1999 Hoffman ..... 335/177
8,258,904 B2 * 9/2012 Ben-Asher et al. ..... 335/220
2002/0093408 A1 * 7/2002 Morita et al. ..... 335/220

FOREIGN PATENT DOCUMENTS

EP 0 442 311 8/1991
FR 2 344 948 10/1977

OTHER PUBLICATIONS

International Search Report, International Application No. PCT/US2010/002696, International Filing Date Jun. 10, 2010.

* cited by examiner

*Primary Examiner* — Bernard Rojas

(57) ABSTRACT

A solenoid is provided for an electrical switch. The solenoid includes a coil having a passageway extending therethrough along a central longitudinal axis. The solenoid also includes a movable core having a coil segment and a magnet segment. The coil segment is received within the passageway of the coil such that the coil extends around the coil segment. The magnet segment includes a radially outer surface relative to the central longitudinal axis of the passageway of the coil. The movable core is movable relative to the coil along the central longitudinal axis such that the coil segment is movable within the passageway of the coil along the central longitudinal axis. A permanent magnet extends around at least a portion of the radially outer surface of the magnet segment of the movable core. The movable core is movable along the central longitudinal axis relative to the permanent magnet.

15 Claims, 5 Drawing Sheets

MAGNET AIDED SOLENOID FOR AN ELECTRICAL SWITCH

BACKGROUND OF THE INVENTION

The subject matter described and/or illustrated herein relates generally to electrical switches, and more particularly, to solenoids for electrical switches.

Electrical switches (e.g., contactors, relays, and the like) exist today for opening and closing an electrical circuit between various electrical devices. For example, electrical switches are sometimes used to electrically connect and disconnect an electrical device from an electrical power source. Typical electrical switches include an actuator and one or more movable contacts connected to the actuator. Electrical current is applied to the actuator to move the movable contact into or out of engagement with stationary contacts that are electrically connected to corresponding ones of the electrical devices. The electrical circuit between the electrical devices is thereby completed or broken depending on whether the movable contact is engaged or disengaged with the stationary contacts.

The actuator of some known electrical switches is a solenoid, which may include a coil that surrounds a movable core. A ferromagnetic coil shell typically extends around the coil. Energization of the coil with electrical power generates a magnetic flux that moves the movable core within the coil. The movable core is connected to an actuator rod that is connected to the movable contact of the electrical switch. As the movable core moves within the coil, the actuator rod and movable contact move along with the movable core to engage or disengage the movable contact from the stationary contacts.

The coil, coil shell, and/or other components of the solenoid and/or switch are selected to provide a predetermined amount of magnetic flux. The predetermined magnetic flux provides a predetermined movement force for moving the movable contact into or out of engagement with the stationary contacts. The movement force may need to be high enough to overcome the friction and/or inertia of the movable core and/or other components of the solenoid and/or switch, such as the actuator rod. The predetermined magnetic flux also provides a predetermined contact force for holding the movable contact in engagement with or disengagement from the stationary contacts. The movement force and/or the contact force may also need to be high enough to overcome the bias of a spring that biases the movable contact to be disengaged from or engaged with the stationary contacts. But, to provide even relatively small increases to the predetermined magnetic flux, a size of the coil, the coil shell, and/or other ferromagnetic components of the solenoid and/or the switch may need to be increased more than is desired. As the size of the coil, coil shell, and/or other ferromagnetic components increases, the solenoid and/or the switch may become undesirably bulky and/or heavy. Moreover, the increased amount of ferromagnetic material used to fabricate the coil, the coil shell, and/or the other ferromagnetic components may increase a cost of the solenoid and/or the switch. Further, at least some of the increased magnetic flux may be wasted because the physical coupling between the coil and the movable core may decrease as the size of the coil increases.

BRIEF DESCRIPTION OF THE INVENTION

In one embodiment, a solenoid is provided for an electrical switch. The solenoid includes a coil having a passageway extending therethrough along a central longitudinal axis. The solenoid also includes a movable core having a coil segment and a magnet segment. The coil segment is received within the passageway of the coil such that the coil extends around the coil segment. The magnet segment includes a radially outer surface relative to the central longitudinal axis of the passageway of the coil. The movable core is movable relative to the coil along the central longitudinal axis such that the coil segment is movable within the passageway of the coil along the central longitudinal axis. A permanent magnet extends around at least a portion of the radially outer surface of the magnet segment of the movable core. The movable core is movable along the central longitudinal axis relative to the permanent magnet.

In another embodiment, an electrical switch includes an electrical contact, an actuator rod connected to the electrical contact, and a solenoid. The solenoid includes a coil having a passageway extending therethrough along a central longitudinal axis, and a movable core having a coil segment and a magnet segment. The coil segment is received within the passageway of the coil such that the coil extends around the coil segment. The magnet segment includes a radially outer surface relative to the central longitudinal axis of the passageway of the coil. The movable core is movable relative to the coil along the central longitudinal axis. The movable core is connected to the actuator rod such that the actuator rod is movable with the movable core along the central longitudinal axis. Movement of the movable core moves the electrical contact into and out of engagement with a mating contact. The solenoid also includes a permanent magnet extending around at least a portion of the radially outer surface of the magnet segment of the movable core.

DETAILED DESCRIPTION OF THE INVENTION

Figure 1:
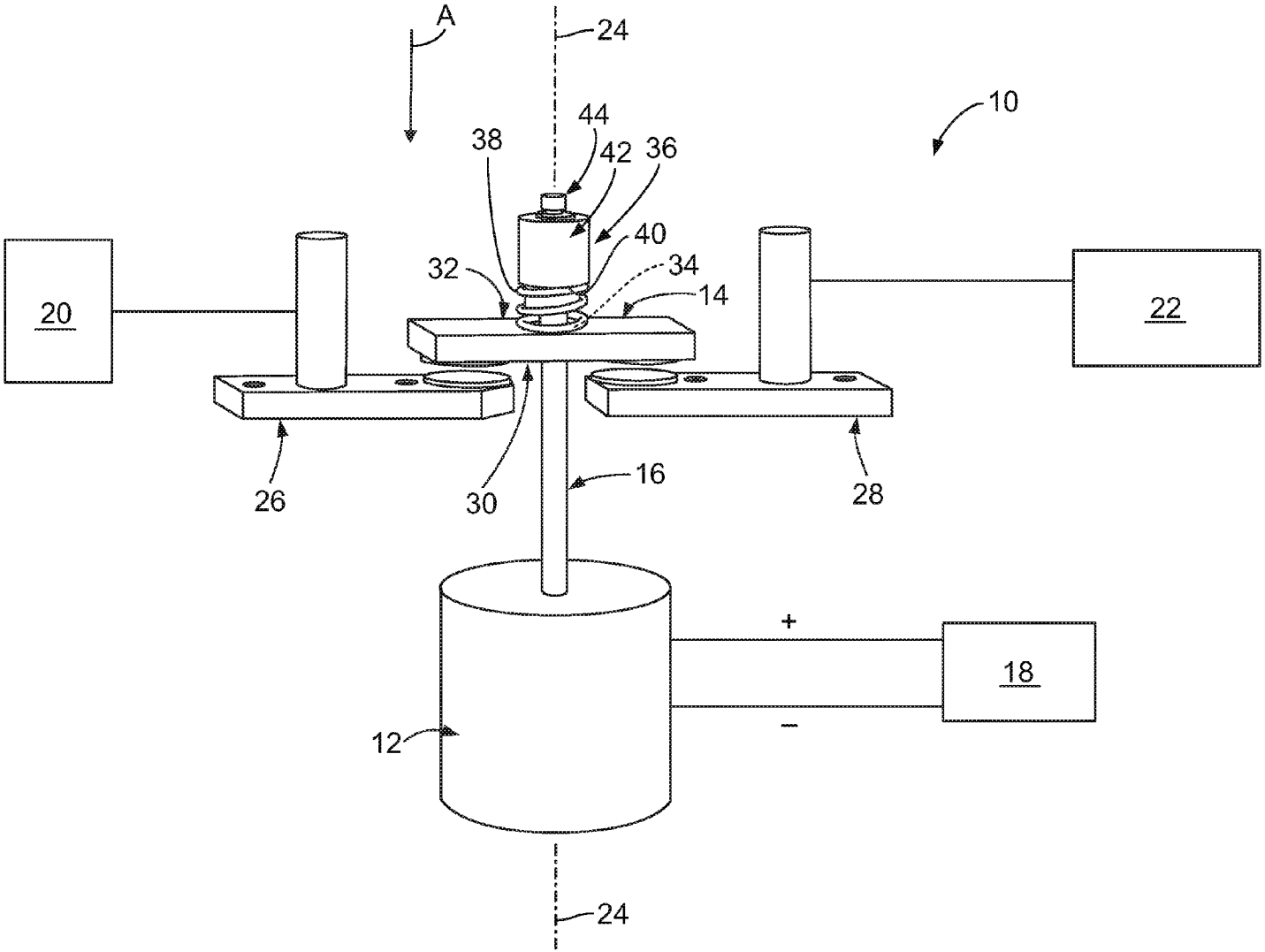
FIG. 1 is a schematic view of an exemplary embodiment of an electrical switch.
Figure 2:
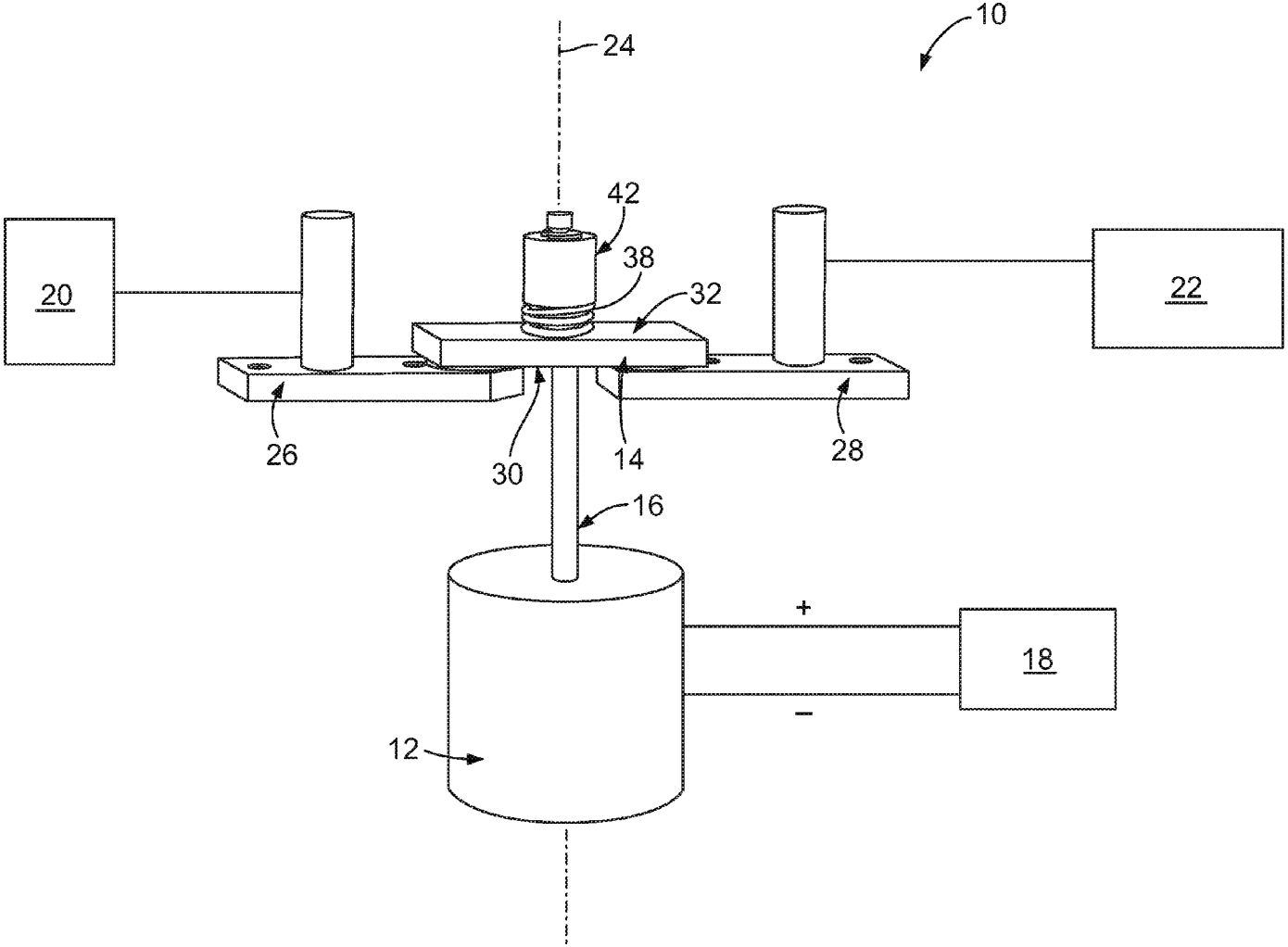
FIG. 2 is a schematic view of the electrical switch illustrating an exemplary embodiment of a movable contact of the switch in a closed position.

FIG. 1 is a schematic view of an exemplary embodiment of an electrical switch 10. The switch 10 includes a solenoid 12, a movable contact 14, and an actuator rod 16 that connects the solenoid 12 to the movable contact 14. The solenoid 12 is electrically connected to a source 18 of electrical power for driving operation of the solenoid 12. The switch 10 is used to selectively open and close an electrical circuit between two or more electrical devices 20 and 22. Specifically, and as will be described below, the solenoid 12 is configured to move the actuator rod 16 along a central longitudinal axis 24 of the switch 10. As the actuator rod 16 moves along the central longitudinal axis 24, the movable contact 14 moves between an open position, shown in FIG. 1, and a closed position (FIG. 2). In the open position, the movable contact 14 is disengaged from a pair of stationary contacts 26 and 28 that are electrically connected to respective ones of the electrical devices 20 and 22. In the closed position, the movable contact 14 is engaged with the stationary contacts 26 and 28 such that the electrical devices 20 and 22 are electrically connected to each other. In other words, when the movable contact 14 is engaged with the stationary contacts 26 and 28, the movable contact 14 completes an electrical circuit between the stationary contacts 26 and 28, and thus between the electrical devices 20 and 22. FIG. 2 illustrates the closed position of the movable contact 14 wherein the movable contact 14 is engaged with the stationary contacts 26 and 28. Although shown as having a generally cylindrical shape, in addition or alternative the actuator rod 16 may include any other shape, such as, but not limited to, a rectangular shape and/or the like.

Referring again to FIG. 1, the switch 10 optionally includes a housing (not shown) that encloses at least a portion of the solenoid 12, at least a portion of the actuator rod 16, at least a portion of the movable contact 14, and/or at least a portion of the stationary contacts 26 and/or 28. The movable contact 14 includes an engagement side 30 and an opposite side 32. The engagement side 30 engages the stationary contacts 26 and 28 when the movable contact 14 is in the closed position. The actuator rod 16 optionally extends through an opening 34 within the movable contact 14 such that an end 36 of the actuator rod 16 extends outward from the side 32 of the movable contact 14. Optionally, the switch 10 includes a spring 38 that extends around the actuator rod 16 adjacent the movable contact 14. The spring 38 engages the side 32 of the movable contact 14 and a ledge 40 of the actuator rod 16. In the exemplary embodiment, the ledge 40 is defined by a collar 42 that extends around the actuator rod 16. Alternatively, the ledge 40 is an integral structure of the peripheral surface of the actuator rod 16. A set screw 44, any other type of fastener, any other type of structure, and/or the like may be provided to hold the collar 42 on the actuator rod 16. The collar 42 may facilitate preventing the end 36 of the actuator rod 16 from moving back through the opening 34 within the movable contact 14. Although the spring 38 is shown herein as a helical spring, the spring 38 may be any other type of spring and/or biasing mechanism, such as, but not limited to, a leaf spring and/or the like.

The spring 38 allows the moveable contact 14 to move with, and also relative to, the actuator rod 16. Specifically, and beginning in the open position shown in FIG. 1, as the solenoid 12 moves the actuator rod 16 along the central longitudinal axis 24 in the direction of the arrow A, the movable contact 14 moves along with the actuator rod 16 and toward the stationary contacts 26 and 28. The movable contact 14 moves along with the actuator rod 16 until the movable contact 14 engages the stationary contacts 26 and 28. As the actuator rod 16 continues to move along the central longitudinal axis 24 in the direction A, the movable contact 14 is restrained by the stationary contacts 26 and 28 and therefore slidably moves along, and with respect to, the actuator rod 16. As the movable contact 14 slidably moves along, and with respect to, the actuator rod 16, the spring 38 is compressed. Compression of the spring 38 exerts a force on the movable contact 14 that facilitates maintaining the engagement between the movable contact 14 and the stationary contacts 26 and 28. FIG. 2 illustrates the closed position of the movable contact 14 wherein the spring 38 is compressed.

Figure 3:
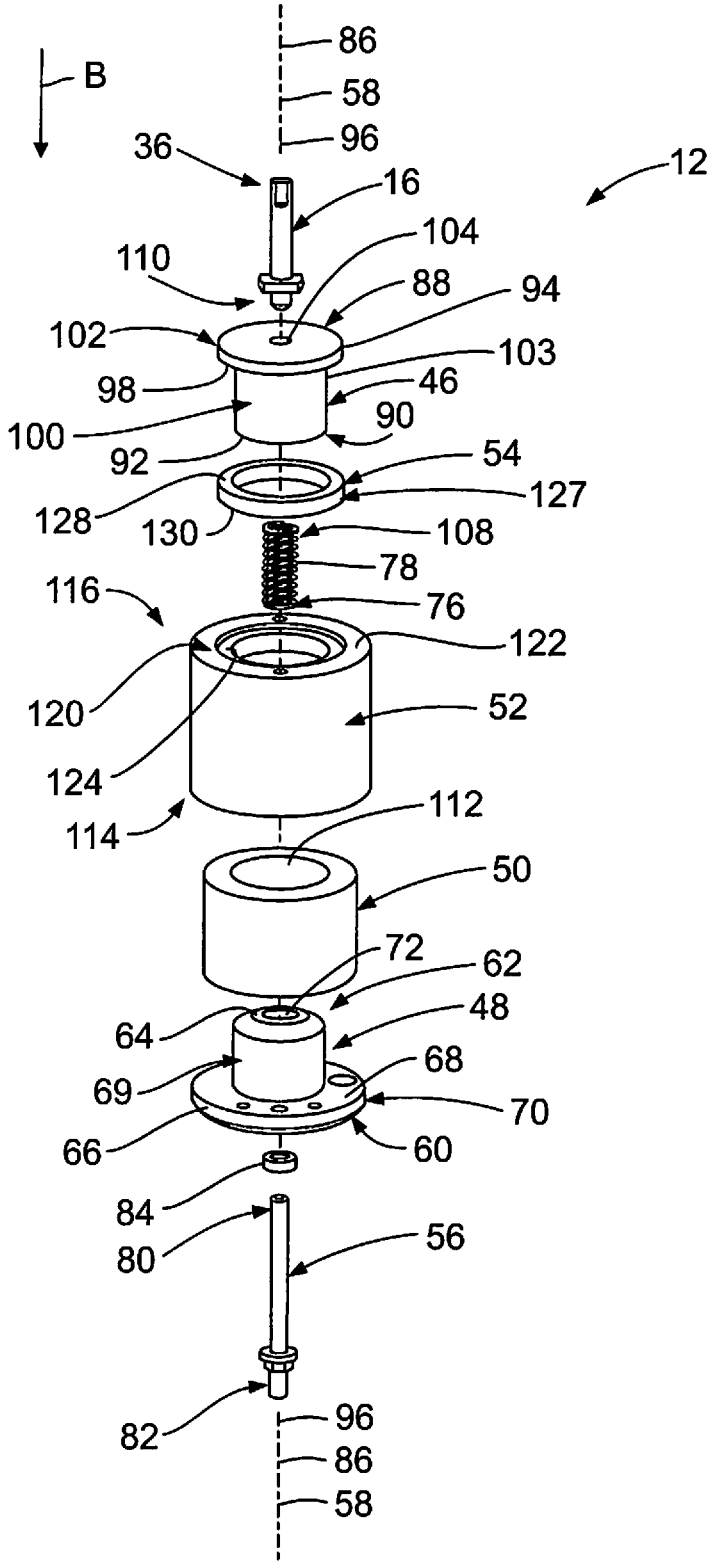
FIG. 3 is an exploded perspective view of an exemplary embodiment of a solenoid of the switch shown in FIGS. 1 and 2.
Figure 4:
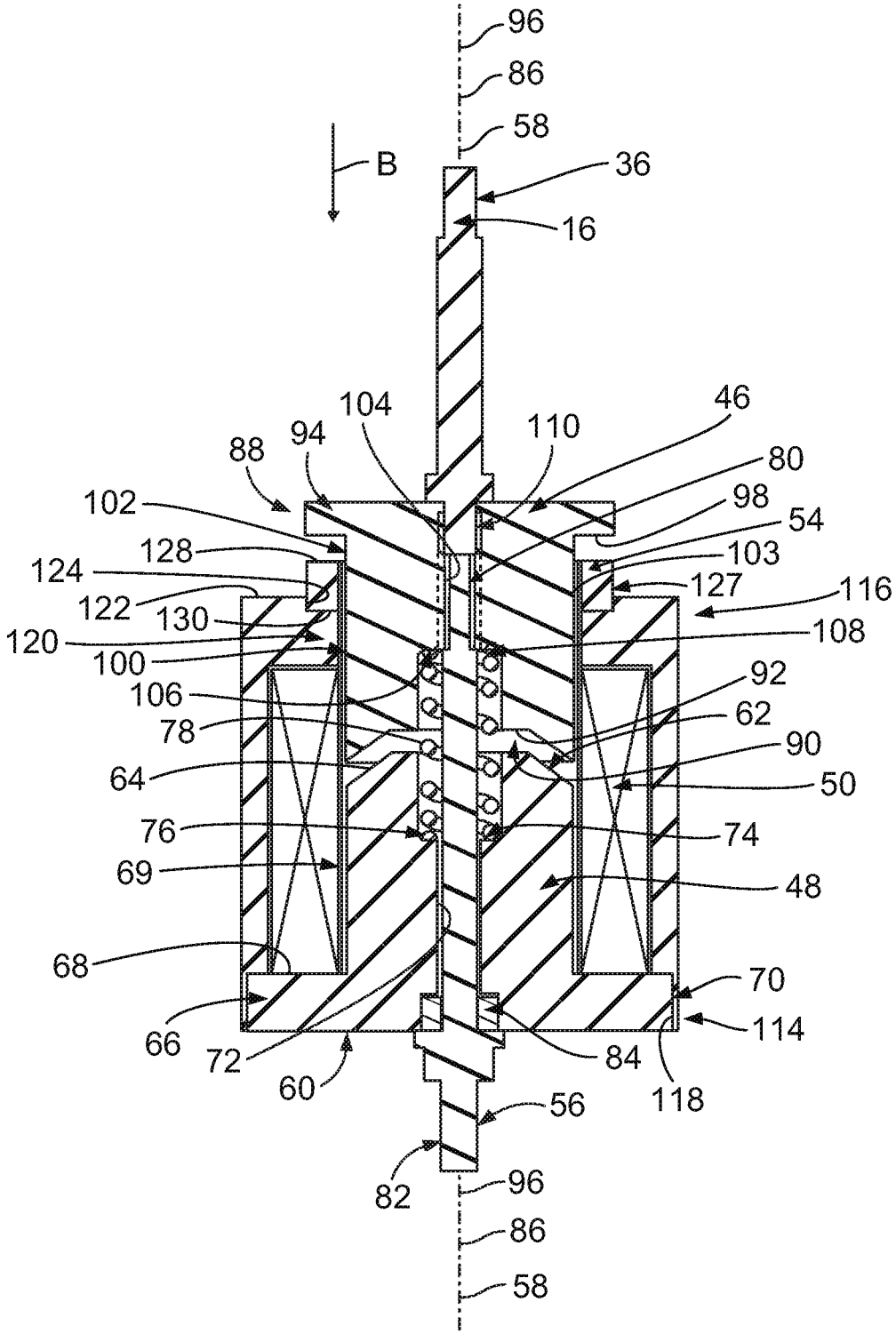
FIG. 4 is a cross-sectional view of the solenoid shown in FIG. 3.

FIG. 3 is an exploded perspective view of an exemplary embodiment of the solenoid 12. FIG. 4 is a cross-sectional view of the solenoid 12. The solenoid 12 includes a movable core 46, an optional stationary core 48, a coil 50, a coil shell 52, a permanent magnet 54, and an optional auxiliary rod 56. The stationary core 48, the movable core 46, and the coil shell 52 are each fabricated from ferromagnetic materials. The actuator rod 16 and the auxiliary rod 56 may each be fabricated from ferromagnetic materials and/or electrically insulating materials. The stationary core 48 extends a length along a central longitudinal axis 58 from an end 60 to an opposite end 62. The end 62 of the stationary core 48 includes an engagement surface 64 that engages the movable core 46 during operation of the solenoid 12. The end 60 of the stationary core 48 includes a flange 66 having a platform surface 68 that supports the coil 50. The stationary core 48 includes a coil segment 69 and a shell segment 70. Specifically, the shell segment 70 includes the end 60 and the flange 66, and the coil segment 69 extends outwardly from the shell segment 70 and includes the end 62. In the exemplary embodiment, a channel 72 extends through the length of the stationary core 48. The channel 72 includes an optional spring perch 74 (not visible in FIG. 3) adjacent the end 62. As will be described below, the end 76 of a return spring 78 is received within the channel 72 and abuts the spring perch 74. As best seen in FIG. 3, the stationary core 48 has a generally cylindrical shape in the exemplary embodiment. In addition or alternative to the cylindrical shape, the stationary core 48 may include any other shape, such as, but not limited to, a rectangular shape and/or the like.

In the exemplary embodiment, the solenoid 12 includes the auxiliary rod 56, which extends a length from an end 80 to an opposite end 82. The auxiliary rod 56 extends through the channel 72 of the stationary core 48 such that a portion of the length of the auxiliary rod 56 is received within the channel 72. The auxiliary rod 56 is configured to slidably move along the central longitudinal axis 58 relative to the stationary core 48. An optional bushing 84 surrounds the auxiliary rod 56 adjacent the end 60 of the stationary core 48. The bushing 84 extends between the auxiliary rod 56 and a surface of the stationary core 48 that defines the channel 72 for guiding and facilitating movement of the auxiliary rod 56 relative to the stationary core 48. The end 82 of the auxiliary rod 56 may be connected to one or more auxiliary movable contacts (not shown) for selectively engaging and disengaging the auxiliary movable contact with auxiliary stationary contacts (not shown). In other words, when the auxiliary movable contact is engaged with the auxiliary stationary contacts, the auxiliary movable contact completes an auxiliary electrical circuit between auxiliary electrical devices (not shown). Although shown as having a generally cylindrical shape, in addition or alternative the auxiliary rod 56 may include any other shape, such as, but not limited to, a rectangular shape and/or the like.

In some alternative embodiments, the stationary core 48 does not include the channel 72 and/or the spring perch 74. The channel 72 may alternatively only extend partially through the length of the stationary core 48. For example, the stationary core 48 may not include the channel 72 and/or the channel 72 may extend only partially through the length of the stationary core 48 in embodiments wherein the solenoid 12 does not include the auxiliary rod 56. Moreover, and for example, the stationary core 48 may not include the spring perch 74 in embodiments wherein the return spring 78 does not extend within the channel 72, but rather abuts the engagement surface 64 of the stationary core 48.

The movable core 46 extends a length along a central longitudinal axis 86 from an end 88 to an opposite end 90. In the exemplary embodiment, the central longitudinal axis 86 of the movable core 46 is aligned with the central longitudinal axis 58 of the stationary core 48. The end 90 of the movable core 46 includes an engagement surface 92 that engages the engagement surface 64 of the stationary core 48 during operation of the solenoid 12. The end 88 of the movable core 46 includes a flange 94 extending radially outward relative to the central longitudinal axis 86 of the movable core 46 (and radially outward relative to a central longitudinal axis 96 of the coil 50). The flange 94 includes a ledge 98. The movable core 46 includes a coil segment 100 and a magnet segment 102. Specifically, the magnet segment 102 includes the end 88 and the flange 94, and the coil segment 100 extends outwardly from the magnet segment 102 and includes the end 90. The magnet segment 102 includes a radially outer surface 103 relative to the central longitudinal axis 96 of the coil 50. A channel 104 extends through the length of the movable core 46. The channel 104 includes an optional spring perch 106 (not visible in FIG. 3) adjacent the end 90. An end 108 of the return spring 78 is received within the channel 104 and abuts the spring perch 106. As will be described below, the return spring 78 biases the movable and stationary cores 46 and 48, respectively, away from each other along the central longitudinal axes 96 and 24 (FIGS. 1 and 2) of the coil 50 and switch 10 (FIGS. 1 and 2), respectively. As best seen in FIG. 3, the movable core 46 has a generally cylindrical shape in the exemplary embodiment. In addition or alternative to the cylindrical shape, the movable core 46 may include any other shape, such as, but not limited to, a rectangular shape and/or the like. Although the return spring 78 is shown herein as a helical spring, the return spring 78 may be any other type of spring and/or biasing mechanism, such as, but not limited to, a leaf spring and/or the like.

In the exemplary embodiment, the auxiliary rod 56 extends partially through the channel 104 of the movable core 46 such that a portion of the lens of the auxiliary rod 56 is received within the channel 104. The auxiliary rod 56 is connected to the movable core 46 for movement therewith along the central longitudinal axes 96 and 24 of the coil 50 and switch 10, respectively. The actuator rod 16 also extends partially through the channel 104 of the movable core 46 in the exemplary embodiment. Specifically, an end 110 of the actuator rod 16 that is opposite the end 36 is received within the channel 104. The end 110 of the actuator rod 16 abuts the end 80 of the auxiliary rod 56. The actuator rod 16 is connected to the movable core 46 for movement therewith along the central longitudinal axes 96 and 24 of the coil 50 and switch 10, respectively.

In alternative to the arrangement shown in FIGS. 3 and 4, the auxiliary rod 56 may not extend within the channel 104 of the movable core 46 and/or the actuator rod 16 may extend within the channel 72 of the stationary core 48. The channel 104 may alternatively only extend partially through the length of the movable core 46. Moreover, in some alternative embodiments the movable core 46 does not include the channel 104 and/or the spring perch 106. For example, the movable core 46 may not include the channel 104 in embodiments wherein the end 110 of the actuator rod 16 is connected to an exterior surface of the end 88 of the movable core 46. Moreover, and for example, the movable core 46 may not include the spring perch 106 in embodiments wherein the return spring 78 does not extend within the channel 104, but rather abuts the engagement surface 92 of the movable core 46.

The coil 50 includes a passageway 112 extending through the coil 50 along the central longitudinal axis 96. In the exemplary embodiment, the central longitudinal axis 96 is aligned with the central longitudinal axis 24 of the switch 10. Moreover, in the exemplary embodiment, the central longitudinal axis 96 of the coil passageway 112 is aligned with the central longitudinal axes 58 and 86 of the stationary and movable cores 48 and 46, respectively. As can be seen in FIG. 4, the coil 50 abuts the platform surface 68 of the flange 66 of the stationary core 48. The flange 66 of the stationary core 48 thereby supports the coil 50. The coil segment 69 of the stationary core 48 extends within the passageway 112 of the coil 50 such that the coil 50 extends around the coil segment 69. Similarly, the coil segment 100 of the movable core 46 is received within the passageway 112 of the coil 50 such that the coil 50 extends around the coil segment 100.

The movable core 46 is movable relative to the coil 50 along the central longitudinal axis 96 of the coil passageway 112 such that the coil segment 100 of the movable core 46 is movable within the coil passageway 112 along the central longitudinal axis 96. The movable core 46 is movable along the central longitudinal axis 96 of the coil passageway 112 between an open position, shown in FIG. 4, and a closed position (not shown). In the open position, the engagement surface 92 of the movable core 46 is not engaged with the engagement surface 64 of the stationary core 48 and the movable contact 14 (FIGS. 1 and 2) is not engaged with the stationary contacts 26 and 28 (FIGS. 1 and 20. In the closed position, the engagement surface 92 of the movable core 46 is engaged with the engagement surface 64 of the stationary core 48 and the movable contact 14 is engaged with the stationary contacts 26 and 28. The return spring 78 biases that movable core 46 to the open position.

The coil 50 is electrically connected to the electrical power source 18 (FIGS. 1 and 2) for energizing the coil 50 with electrical current from the power source 18. The electrical connection between the coil 50 and the electrical power source 18 is not shown in FIGS. 3 and 4, but electrical connection between the electrical power source 18 and the solenoid 12 generally can be seen in FIGS. 1 and 2. A switch (not shown) may be provided for selectively opening and closing the electrical connection between the coil 50 and the electrical power source 18.

Energization of the coil 50 with electrical power generates a magnetic flux that moves the movable core 46 along the central longitudinal axis 96 of the coil passageway 112. The magnetic flux of the coil 50 may be referred to herein as "coil flux". In the exemplary embodiment, the magnetic flux of the coil 50 moves the movable core 46 along the central longitudinal axis 96 in the direction of the arrow B, against the bias of the return spring 78. In other words, in the exemplary embodiment, the magnetic flux of the coil 50 moves the movable core 46 from the open position to the closed position. In the exemplary embodiment, the switch 10 is a "normally open" switch because the movable core 46 is biased by the return spring 78 to the open position, because the open position of the movable core 46 corresponds to the open position of the movable contact 14, and because energization of the coil 50 with electrical power moves the movable core 46 to the closed position. Alternatively, the switch 10 is a "normally closed" switch. For example, in some alternative embodiments, the return spring 78 biases the movable core 46 to a position wherein the movable contact 14 is engaged with the stationary contacts 26 and 28 and energization of the coil 50 with electrical power generates a magnetic flux that moves the movable core 46, against the bias of the return spring 78, to a position wherein the movable contact 14 is disengaged from the stationary contacts 26 and 28. In such alternative embodiments wherein the switch 10 is a normally closed switch, the movable core 46 may be either engaged or disengaged with the stationary core 48 in the position of the movable core 46 wherein the movable contact 14 is engaged with the stationary contacts 26 and 28.

The coil shell 52 extends a length from an end 114 to an opposite end 116. The end 114 of the coil shell includes a recess 118 (not visible in FIG. 3) that receives the flange 66 of the stationary core 48 therein. The end 116 of the coil shell 52 includes a coil lid 120, which includes an end surface 122 having an optional recess 124. In the exemplary embodiment, the coil lid 120 is integrally formed with the remainder of the coil shell 52. Alternatively, the coil lid 120 is formed as a separate component from the remainder of the coil shell 52. The coil shell 52 extends around the coil 50. Specifically, the coil 50 is sandwiched between the coil lid 120 and the flange 66 of the stationary core 48. Although shown and described herein as a separately formed component, the stationary core 48 may alternatively be integrally formed with the coil shell 52. In the exemplary embodiment, the coil shell 52 has a generally cylindrical shape. In addition or alternative to the generally cylindrical shape, the coil shell 52 may include any other shape, such as, but not limited to, a rectangular shape and/or the like.

The permanent magnet 54 includes a body 127 extending from an end surface 128 to an opposite end surface 130. The body 127 of the permanent magnet 54 extends around at least a portion of the radially outer surface 103 of the magnet segment 102 of the movable core 46. In the exemplary embodiment, the permanent magnet 54 extends continuously around the radially outer surface 103 of the magnet segment 102 of the movable core 46. The permanent magnet 54 is positioned such that the end surface 128 faces the ledge 98 of the flange 94 of the movable core 46, and such that the end surface 128 is spaced apart from the ledge 98 of the flange 94 by a gap. Optionally, the permanent magnet 54 is held at least partially within the recess 124 within the coil lid 120.

As will be described below, the movable core 46 is movable along the central longitudinal axis 96 relative to the permanent magnet 54. The permanent magnet 54 generates a magnetic flux that applies a force to the movable core 46 that moves the movable core 46 along the central longitudinal axis 96. The magnetic flux of the permanent magnet 54 increases the amount of force applied to the movable core 46 by the magnetic flux of the coil 50. In other words, the force of the magnetic flux generated by the permanent magnet 54 is additive with the force of the magnetic flux generated by the coil 50. The magnetic flux of the coil 50 and the magnetic flux of the permanent magnet 54 thereby combine to move the movable core 46 along the central longitudinal axis 96 of the coil 50 in the direction of the arrow B. In some embodiments, the magnetic flux exerted on the movable core 46 by the permanent magnet 54 increases as the flange 94 of the movable core 46 moves toward the end surface 128 of the permanent magnet 54. The permanent magnet 54 may be selected to provide any level of magnetic flux to the movable core 46. The magnetic flux of the permanent magnet 54 may be referred to herein as "magnet flux".

As best seen in FIG. 3, the body 127 of the permanent magnet extends along a curved path in the exemplary embodiment. More specifically, in the exemplary embodiment, the body 127 of the permanent magnet 54 has a circular shape. In addition or alternative to the circular shape, the body 127 of the permanent magnet 54 may include any other shape, such as, but not limited to, rectangular, oval shaped, triangular, and/or the like. Moreover, in the exemplary embodiment, the body 127 of the permanent magnet 54 is a continuous body that extends continuously around the radially outer surface 103 of the magnet segment 102 of the movable core 46. Alternatively, the body 127 of the permanent magnet 54 extends around only a portion of the radially outer surface 103 of the magnet segment 102 of the movable core 46. Although one is shown and described herein, the solenoid 12 may include any number of permanent magnets 54.

Figure 5:
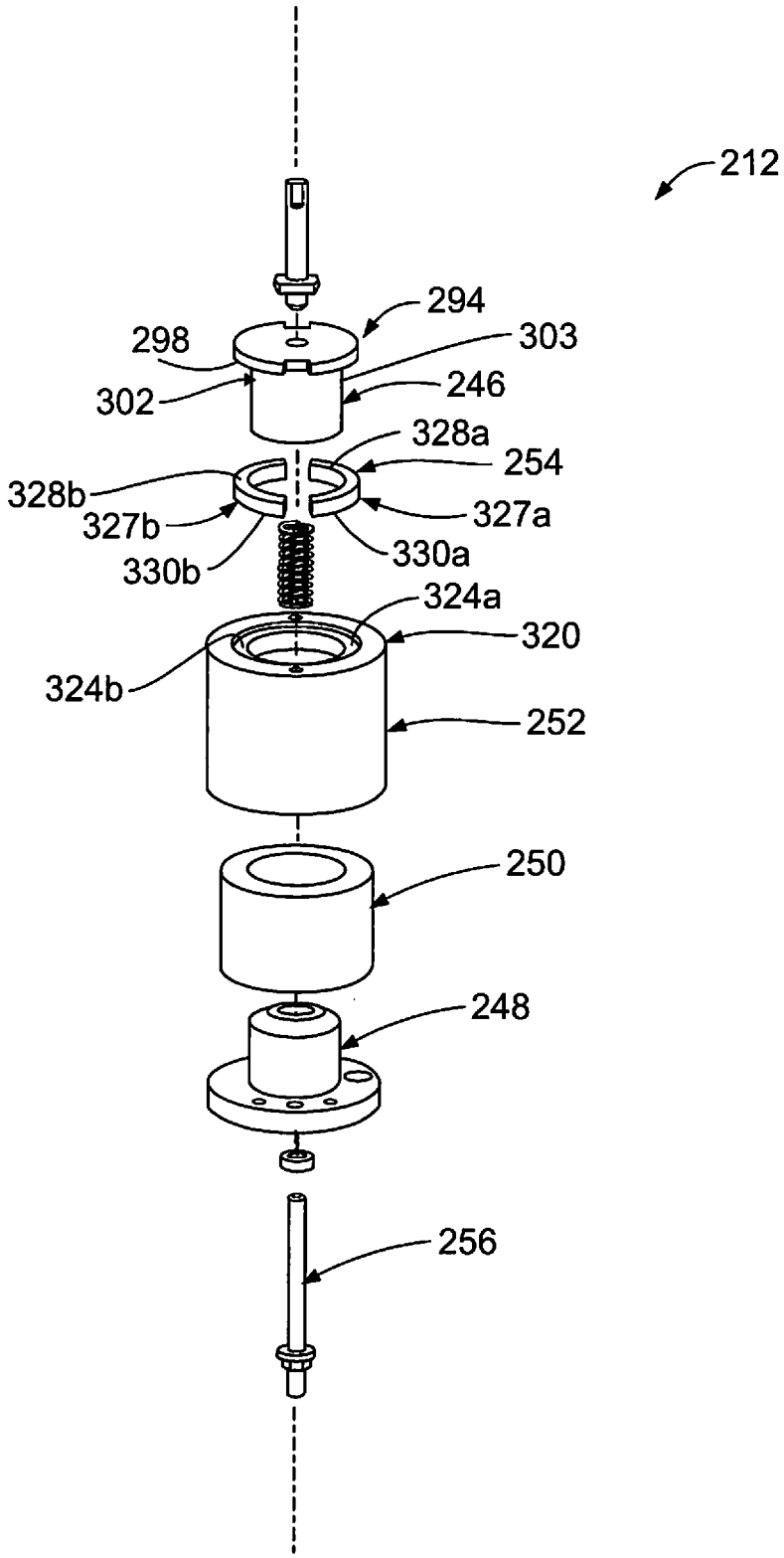
FIG. 5 is an exploded perspective view of an exemplary alternative embodiment of a solenoid of the switch shown in FIGS. 1 and 2.

In the exemplary embodiment, the permanent magnet 54 is defined by a single body 127. Alternatively, the permanent magnet 54 is defined by at least two separate and distinct bodies 127 that each extend around a different portion of the radially outer surface 103 of the magnet segment 102 of the movable core 46. For example, FIG. 5 is an exploded perspective view of an exemplary alternative embodiment of a solenoid 212 of the switch 10 (FIGS. 1 and 2). The solenoid 212 includes a movable core 246, an optional stationary core 248, a coil 250, a coil shell 252, a permanent magnet 254, and an optional auxiliary rod 256. The movable core 246 includes a magnet segment 302 having a radially outer surface 303 and a flange 294, which includes a ledge 298. The coil shell 252 includes a coil lid 320 having a pair of recesses 324*a* and 324*b* extending therein.

The permanent magnet 254 includes two separate and distinct bodies 327*a* and 327*b*. Each body 327*a* and 327*b* extends from a respective end surface 328*a* and 328*b* to an opposite end surface 330*a* and 330*b*, respectively. Each body 327*a* and 327*b* of the permanent magnet 254 extends around a different portion of the radially outer surface 303 of the magnet segment 302 of the movable core 246. The bodies 327*a* and 327*b* are positioned such that the respective end surfaces 328*a* and 328*b* face the ledge 298 of the flange 294 of the movable core 246, and such that the end surfaces 328*a* and 328*b* are spaced apart from the ledge 298 of the flange 294 by a gap. Optionally, the bodies 327*a* and 327*b* are held at least partially within the respective recesses 328*a* and 328*b* within the coil lid 320. Although two bodies 327*a* and 327*b* are shown and described herein, the permanent magnet 254 may include any number of the bodies 327. Moreover, although each body 327*a* and 327*b* is shown as extending around approximately half of the radially outer surface 303 of the movable core 246, each body 327*a* and 327*b* may alternatively extend around less than half of the radially outer surface 303.

In operation, and referring now to FIGS. 1-4, the movable core 46, and thus the movable contact 14, is biased to the open positions shown in FIGS. 3 and 1, respectively. In the open position, the movable contact 14 is disengaged from the stationary contacts 26 and 28, such that the electrical circuit between the electrical devices 20 and 22 is broken. To close the movable contact 14 and thereby complete the electrical circuit between the electrical devices 20 and 22, electrical power is applied to the coil 50 of the solenoid 12 using the electrical power source 18. When the coil 50 is energized, the magnetic flux of the coil 50 moves the movable core 46 along the central longitudinal axis 96 of the coil 50 in the direction B shown in FIGS. 3 and 4. The magnetic flux of the permanent magnet 54 increases the amount of force applied to the movable core 46 by the magnetic flux of the coil 50. The magnetic flux of the coil 50 and the magnetic flux of the permanent magnet 54 thereby combine to move the movable core 46 along the central longitudinal axis 96 of the coil 50 in the direction B. As the movable core 46 moves in the direction B, the actuator rod 16 moves along with the movable core 46 in the direction B. The movable contact 14 moves along with the actuator rod 16, which is indicated by the arrow A in FIG. 1, until the movable contact 14 engages the stationary contacts 26 and 28, thereby completing the electrical circuit between the electrical devices 20 and 22. FIG. 2 illustrates the closed position of the movable contact 14 wherein the movable contact 14 is engaged with the stationary contacts 26 and 28.

Referring now to FIGS. 3 and 4, if included, the auxiliary rod 56 also moves along with the movable core 46 in the direction B. Movement of the auxiliary rod 56 moves the auxiliary movable contact in the direction B to engage or disengage the auxiliary movable contact with auxiliary stationary contacts.

Referring again to FIGS. 1 and 2, the stationary contacts 26 and/or 28 may be components of the switch 10 or may alternatively be components of the respective electrical devices 20 and 22. Each of the electrical devices 20 and 22 may be any type of electrical device. In the exemplary embodiment, the electrical circuit formed by the switch 10 between the electrical devices 20 and 22 transmits electrical power. In addition or alternative, the electrical circuit formed by the switch 10 between the electrical devices 20 and 22 may transmit electrical power and/or electrical ground. Although two are shown and described herein, the switch 10 may electrically connect and disconnect any number of electrical devices. Moreover, the switch 10 may include any number of the movable contacts 14 for engagement with any number of stationary contacts.

The embodiments described and/or illustrated herein may provide a solenoid and/or a switch having a smaller and/or lighter coil, coil shell, and/or other ferromagnetic components for a given magnetic flux as compared with at least some known solenoids and/or switches. The embodiments described and/or illustrated herein may provide, for a given magnetic flux, a solenoid and/or a switch that is less expensive than at least some known solenoids and/or switches. The embodiments described and/or illustrated herein may provide a solenoid and/or a switch having a greater magnetic flux as compared with at least some known solenoids and/or switches of the same size and/or weight.

It is to be understood that the above description and the figures are intended to be illustrative, and not restrictive. For example, the above-described and/or illustrated embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components (including the terms "upper", "lower", "vertical", and "lateral"), and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description and the figures. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A solenoid for an electrical switch, said solenoid comprising:

a coil having a passageway extending therethrough along a central longitudinal axis;

a movable core having a coil segment and a magnet segment, the coil segment being received within the passageway of the coil such that the coil extends around the coil segment, the magnet segment including a radially outer surface relative to the central longitudinal axis of the passageway of the coil, the movable core being movable relative to the coil along the central longitudinal axis such that the coil segment is movable within the passageway of the coil along the central longitudinal axis, the moveable core comprising a flange extending radially outward relative to the central longitudinal axis of the passageway of the coil, flange comprising a ledge;

a spring in direct contact with the movable core to bias the movable core to one of an open position or a closed position;

a permanent magnet extending around at least a portion of the radially outer surface of the magnet segment of the movable core, the movable core being movable along the central longitudinal axis relative to the permanent magnet, the permanent magnet comprising an end surface that faces the ledge of the flange of the moveable core, the end surface being spaced apart from the ledge by an air gap that extends from the end surface to the ledge; and a coil shell extending around the coil, the coil shell comprising a side wall that extends around the coil, the coil shell comprising a coil lid that extends from the side wall at a non-parallel angle relative to the side wall, the coil lid extending over an end of the coil, the coil lid comprising a recess therein, the permanent magnet being held at least partially within the recess, wherein the coil lid is integrally formed with the side wall.

2. The solenoid according to claim 1, wherein application of electrical power to the coil generates a coil flux that moves the movable core along the central longitudinal axis of the passageway of the coil, the permanent magnet generating a magnet flux that increases an amount of force applied to the movable core by the coil flux.

3. The solenoid according to claim 1, wherein the permanent magnet generates a magnetic flux that moves the movable core along the central longitudinal axis, the magnetic flux increasing as the flange moves toward the permanent magnet.

4. The solenoid according to claim 1, wherein the permanent magnet comprises a continuous body that extends continuously around the radially outer surface of the magnet segment of the movable core.

5. The solenoid according to claim 1, further comprising a stationary core extending at least partially within the passageway of the coil, the movable core being movable along the central longitudinal axis between an open position wherein the movable core does not engage the stationary core and a closed position wherein a protrusion of the stationary core is received within a recess of the movable core such that the movable core is engaged with the stationary core.

6. The solenoid according to claim 1, wherein the permanent magnet comprises at least two separate and distinct magnet bodies each extending around a different portion of the radially outer surface of the magnet segment of the movable core.

7. The solenoid according to claim 1, wherein the permanent magnet comprises a body extending along a curved path.

8. An electrical switch comprising:

an electrical contact;

an actuator rod connected to the electrical contact; and a solenoid comprising:

a coil having a passageway extending therethrough along a central longitudinal axis;

a movable core having a coil segment and a magnet segment, the coil segment being received within the passageway of the coil such that the coil extends around the coil segment, the magnet segment including a radially outer surface relative to the central longitudinal axis of the passageway of the coil, the movable core being movable relative to the coil along the central longitudinal axis, the movable core being connected to the actuator rod such that the actuator rod is movable with the movable core along the central longitudinal axis, wherein movement of the movable core moves the electrical contact into and out of engagement with a mating contact, the moveable core comprising a flange extending radially outward relative to the central longitudinal axis of the passageway of the coil, flange comprising a ledge;

a spring in direct contact with the movable core to bias the movable core to one of an open position or a closed position;

a permanent magnet extending around at least a portion of the radially outer surface of the magnet segment of the movable core, the permanent magnet comprising an end surface that faces the ledge of the flange of the moveable core, the end surface being spaced apart from the ledge by an air gap that extends from the end surface to the ledge; and a coil shell extending around the coil, the coil shell comprising a side wall that extends around the coil, the coil shell comprising a coil lid that extends from the side wall at a non-parallel angle relative to the side wall, the coil lid extending over an end of the coil, the coil lid comprising a recess therein, the permanent magnet being held at least partially within the recess, wherein the coil lid is integrally formed with the side wall.

9. The switch according to claim 8, wherein application of electrical power to the coil generates a coil flux that moves the movable core along the central longitudinal axis of the passageway of the coil, the permanent magnet generating a magnet flux that increases an amount of force applied to the movable core by the coil flux.

10. The switch according to claim 8, wherein the permanent magnet generates a magnetic flux that moves the movable core along the central longitudinal axis, the magnetic flux increasing as the flange moves toward the permanent magnet.

11. The switch according to claim 8, wherein the permanent magnet comprises a continuous body that extends continuously around the radially outer surface of the magnet segment of the movable core.

12. The switch according to claim 8, further comprising a stationary core extending at least partially within the passageway of the coil, the movable core being movable along the central longitudinal axis between an open position wherein the movable core does not engage the stationary core and a closed position wherein the movable core engages the stationary core.

13. The switch according to claim 8, wherein the permanent magnet comprises at least two separate and distinct magnet bodies each extending around a different portion of the radially outer surface of the magnet segment of the movable core.

14. The switch according to claim 8, wherein the permanent magnet comprises a body extending along a curved path.

15. The switch according to claim 8, wherein the movable core comprises a recess that is configured to receive a protrusion of a stationary core therein.

* * * * *